United States Patent [19]

Hitland

[11] 4,406,782

[45] Sep. 27, 1983

[54] CASCADE FLOTATION PROCESS

[75] Inventor: Hjalmar A. K. Hitland, Val d'Or, Canada

[73] Assignee: Ross-Finlay Ltd./Ltee, Val d'Or, Canada

[21] Appl. No.: 276,868

[22] Filed: Jun. 24, 1981

[30] Foreign Application Priority Data

Sep. 2, 1981 [CA] Canada ..... 370407

[51] Int. Cl.[3] ..... B03D 1/02

[52] U.S. Cl. ..... 209/164; 209/168

[58] Field of Search ..... 209/1, 168, 170, 162–165

[56] References Cited

U.S. PATENT DOCUMENTS

| | | | |
|---|---|---|---|
| 1,442,306 | 1/1923 | Stonebraker | 209/168 X |
| 1,869,732 | 8/1932 | Asselstine | 209/170 |
| 2,416,066 | 2/1947 | Phelps | 209/168 |
| 3,255,882 | 6/1966 | McCarty et al. | 209/168 X |
| 3,471,010 | 10/1969 | Pick et al. | 209/168 X |

FOREIGN PATENT DOCUMENTS

| | | | |
|---|---|---|---|
| 43552 | 3/1917 | Sweden | 209/168 |
| 121991 | 6/1948 | Sweden | 209/168 |
| 145870 | 7/1920 | United Kingdom | 209/168 |

*Primary Examiner*—Ralph J. Hill

[57] ABSTRACT

The process of separating minerals or metals from a crushed ore mixture of crushed ore, aqueous solution, and flotation agent by passing the mixture from an inlet through free fall into a container so entrapping air during the free fall and encouraging the development of a large quantity of froth, and an apparatus for separating minerals or metals from a crushed ore mixture consisting of a container and a mixture inlet situated above the container so that an air space exists between the inlet and the upper surface of the mixture in the container during operation.

14 Claims, 5 Drawing Figures

CASCADE FLOTATION PROCESS

This invention relates to a cascade flotation process and apparatus for carrying out the process.

BACKGROUND OF THE INVENTION

The flotation principle as applied to the recovery of minerals or metals from ore has been known for the last century, an example of a known froth flotation apparatus being shown in Canadian Pat. No. 167,476 issued on Feb. 8th, 1916 to Minerals Separation American Syndicate (1913) Limited. This patent relates to the concentration of sulfide ores by froth flotation separation in which the ores are subjected to aeration in an aqueous separating medium in the presence of a frothing agent. The aeration is obtained by passing crushed ore, froth and water through a series of pipes between vertically spaced containers, each pipe having an intermediate open topped container so that air can be entrapped in the mixture by exposure at the open top of the container. The mixture with air therein then passes into the next container through a submerged outlet. This system does provide a certain amount of aeration to the mixture, however it has been determined since this patent that if more air can be entrapped in the mixture then more frothing will occur and a more efficient separation of the mixture will be possible.

Other methods of forming froth have been by aerating an ore mixture in an aqueous medium by vigorous agitation by means of stirrers, impellers, or beaters or by means of injection of compressed air generated by compressors and/or by means of utilizing high capacity centrifugal pumps. Such apparatus consume large amounts of power and are therefore expensive to operate.

SUMMARY OF THE INVENTION

The process of this invention is to permit an aqueous mixture of crushed ore and frothing agents to fall through a down pipe drawing in air by the venturi principle and to cascade through air into a container, so entrapping additional air during the cascading. The mixture is held at a constant level in the container by regulating flow from the bottom of the container and the froth is moved towards a collecting launder by horizontal flow movement over the mixture.

The apparatus of this invention consists of a container having an inlet above the container for admitting an aqueous mixture of crushed ore, flotation agent, and air drawn into the header discharge pipe and into the container by free fall from the header outlet. The level of the mixture in the container is held constant by a sensing device which operates a valve near the base of the container. A collecting launder takes the froth from the top of the container.

The apparatus of this invention will now be described with reference to the accompanying drawing in which:

DETAILED DESCRIPTION OF PREFERRED EMBODIMENTS

Figure 1:
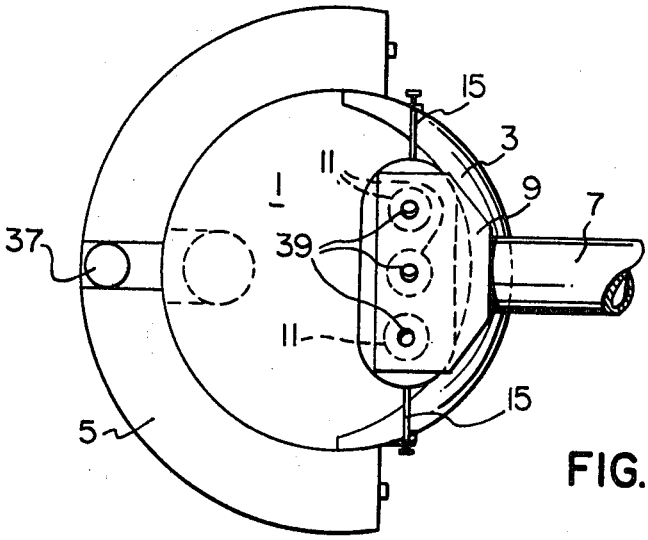
FIG. 1 is a diagrammatic plan view of one embodiment of apparatus for carrying out this invention.
Figure 2:
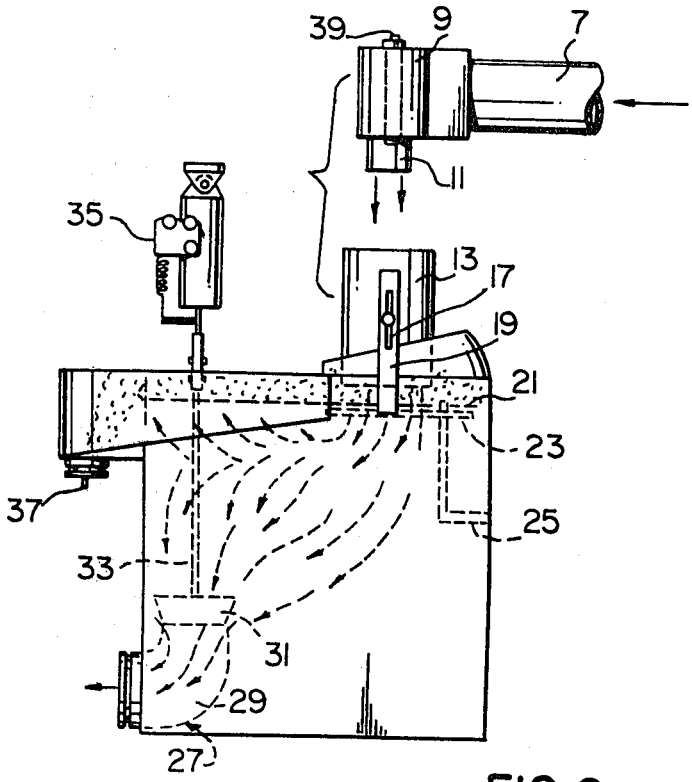
FIG. 2 is a diagrammatic side elevational view of the embodiment as shown in FIG. 1.

Referring to FIGS. 1 and 2, a container 1 has a froth retainer 3 and a froth collecting launder 5. Inlet pipe 7 is coupled to a distribution header box 9 which has three vertically oriented outlet pipes 11 extending from the bottom thereof. Three pipes 11 are shown in this embodiment, however the apparatus will function with a lesser or greater number of outlet pipes, less pipes producing slightly less aeration and more pipes producing sightly more aeration of the mixture. Outlet pipes 11 are each fitted with an air intake venturi pipe 39 extending from above the header box 9 down into the pipe. A shield 13, adjustably held by rods 15 which pass through slots 17 in brackets 19, is positioned immediately below the outlet pipes 11 and above the level 21 of mixture in the container 1. A baffle 23 is situated inside the container below the shield 13 and is secured to the side of the container by a suitable bracket 25. The baffle 23 is shown as being flat and in a horizontally disposed position below the surface of the mixture, however it could be on the surface of the mixture curved, or of any other form or inclined to the horizontal, the position, form and attitude of the baffle being selected to suit the mixture being processed, so as to achieve maximum dispersion of froth and flotation of fine and coarse materials.

A mixture level controlling valve 27 is situated near the base of the container and in the simple form shown consists of a U-shaped hollow body 29 having a stopper 31 which fits in a sealing manner in the top aperture of the body 29. The stopper 31 is secured to a rod 33 which is reciprocally moved by an actuator 35 which is operated through a sensor (not shown) which senses the level 21 of the mixture in the container. An outlet pipe 37 leads off the froth from the collecting launder 5.

The arrows in FIG. 2 show the flow of the mixture entering through pipe 7, and after being aerated, falling through pipes 11 to be further aerated, being diverted against baffle 23 and being dumped through valve 27 to retain a constant level of mixture in the container. Arrows also show the removal of froth through outlet 37.

In carrying out the process of this invention, crushed ore is mixed with water and flotation agents which are selected to suit the ore being treated. Such flotation agents are well-known in the industry and form no part of this invention. The mixture is then passed through pipe 7 into distribution header box 9, wherein it is aerated by venturi pipes 39, and out through pipes 11. The mixture falls freely through the air into the container 1 through the shield 13 which merely reduces the amount of splashing caused when the aerated mixture hits the surface 21 of the mixture in the container. More aeration is achieved by the free fall of the mixture and by the splashing caused at the surface 21. The flow of the mixture is partly controlled in the container by baffle 23 which tends to cause the froth being formed to move towards the collecting launder 5 from which it is retrieved from outlet 37 for further processing. The level of the surface 21 of the mixture in the container is held constant by controlling valve 27, the mixture being dumped through valve 27 either being reprocessed through additional flotation apparatus, passed on to further mill processes or discarded.

By using this process, a very large amount of aeration of the mixture is achieved through the venturi injection of air and the cascading of the mixture from pipes 11 to the surface 21 of the mixture in container 1, and, as the separation efficiency rises through an increase in the aeration in the mixture, the efficiency of this process has been found to be at least as high as any presently known commercial process.

There is also a great reduction in power requirements over known froth flotation processes requiring agitators, stirrers, compressed air injection and the like to provide aeration, as this process can be carried out mainly under the influence of gravity if it is arranged that the apparatus is situated below the ore crushing and mixture preparation apparatus.

Figures 3, 4, 5:
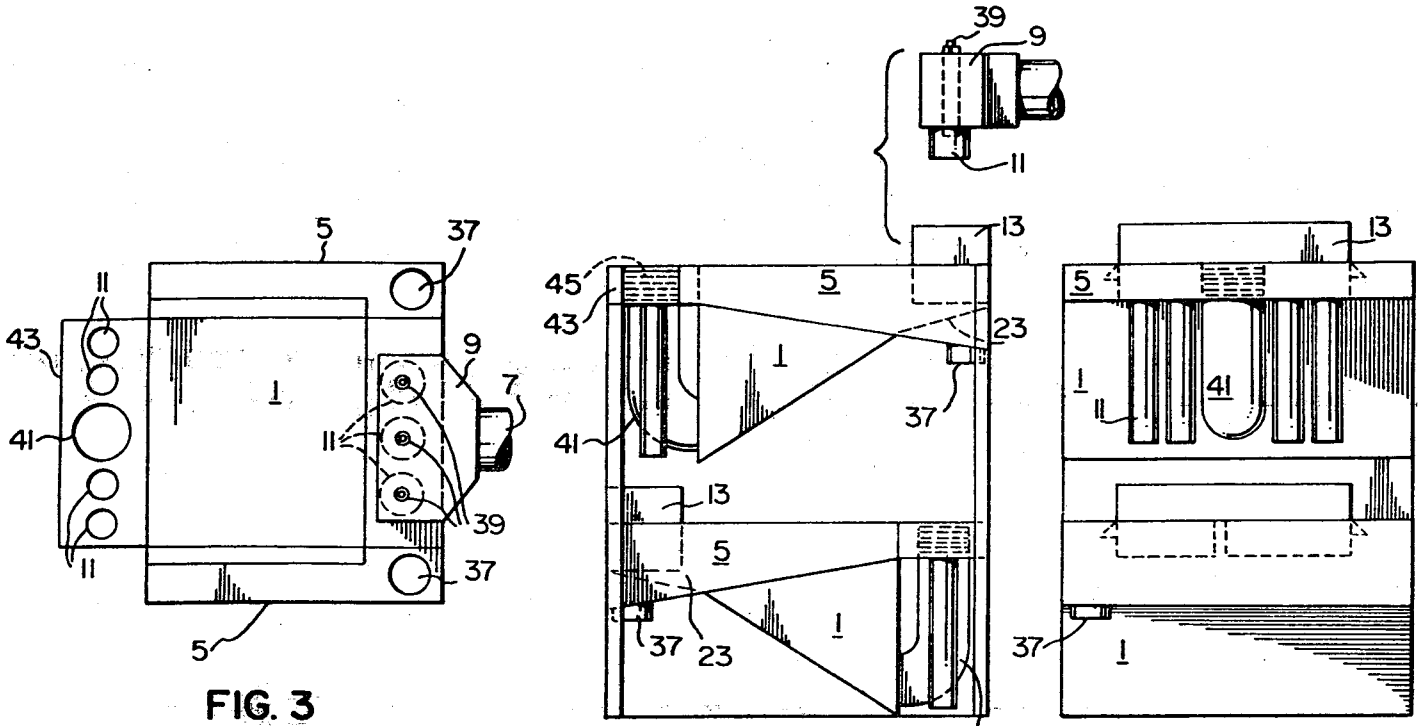
FIG. 3 is a diagrammatic plan view of a second embodiment of apparatus for carrying out this invention.
FIG. 4 is a diagrammatic side elevational view of the embodiment as shown in FIG. 3.
FIG. 5 is a diagrammatic front elevational view of the embodiment as shown in FIG. 3.

Multiple cascading can also be arranged by positioning single units one above the other. An embodiment having two stacked units is shown in FIGS. 3, 4 and 5 and the same reference numerals are used for like parts to those in FIGS. 1 and 2. The level of mixture is a unit is held constant in this embodiment by permitting the mixture left, after froth collection from launder 5, to pass through pipe 41 and flow into a trough 43 so passing through outlet pipes 11 to the next unit. The level of mixture can be controlled at a desired height by use of interfitting collars 45 which are well known for mixture height control in this field. The baffle 23 is also shown in a horizontal attitude in this embodiment but it is preferable that the baffle be adjustable to suit the type of mixture being processed. If additional banks of units are required the residual mixture can be returned to a convenient height by pumping.

Single units can also be usefully employed at the discharge end of a mill to reclaim minerals which would be otherwise lost in the mill tailings flow. A single unit in such a location can recover up to 50 to 75% of the mineral presently being lost without additional expenditures of power or energy with or without additional frothing agents. Some milling processes lose as much or more than 2000 lbs. of mineral in a 24 hour period and therefore recovery of 50% of this amount can produce, with negligible cost, an additional recovery of 1000 lbs. of mineral in a 24 hour period which would otherwise be lost.

The ability of the unit to float much coarser materials and heavier minerals also leads to increased recoveries of heavier precious metals such as gold and silver and faster recoveries of base metals still in a coarse state. For instance Iron is always present as an unwanted mineral in Copper and/or Zinc recovery and can be removed more easily with the unit of this invention. The Iron and Sulphide containing materials can, after removal, be then used as backfill in mining operations instead of being disposed of in tailings disposal areas where they create environment problems.

The ability of the unit to separate coarse material also reduces the necessity for excessively fine grinding of ores to attain maximum mineral recovery.

On screen tests the cascade unit shows remarkable ability to recover coarse materials. A standard recovery at an existing mill has shown that a very fine grind is necessary to obtain a large recovery of Copper and that almost $\frac{3}{4}$ of the recovery is attained at the excessively fine grind of −325 Mesh with standard known Denver TM or Wemco TM units in use, and then only after passing the material through many consecutive standard units. A single cascade unit however, produced over 50% of its concentrate from coarse material, with less than 50% in the fine range. Several successive cascades can recover the same concentrate without the successively fine grinding now used.

The results obtained in the above test are as follows:

| Percent of concentrate produced by weight from: | | | | |
|---|---|---|---|---|
| Grind Mesh Sizing | Denver & Wemco Standard units in Multiple Bank | | Single Cascade Flotation unit | |
| +150 Mesh | 4.07% | 26.73% | 4.95% | 51.64% |
| +200 Mesh | 7.84% | | 18.63% | |
| +325 Mesh | 14.82% | | 28.06% | |
| −325 Mesh | 73.27% | | 48.36% | |

*Trade Marks

The cascade unit therefore produced 51.64% of coarse minerals whereas the standard Denver TM and Wemco TM units in multiple banks produced only 26.73% of coarse minerals.

A test has also been conducted with the cascade unit as a scavenger cell at the tailings end of a mill where it handled the full flow of the mill circuit which was between 1500 and 1800 tons every 24 hours. The recovered concentrate was assayed and produced recoveries of Zinc in concentrate of 21.5 to 26% with high Iron recoveries of 29 to 33%.

The cascade unit was then placed in a primary Copper recovery circuit in the same mill and in a 2 hour 40 minutes test period produced the following results:

| | Time without Cascade Unit | Time with Cascade Unit |
|---|---|---|
| Copper Recovery | 95.90% | 95.44% |
| Zinc Recovery | 82.29% | 85.65% |

Finally, the cascade unit was placed on stream and in a test period of $3\frac{1}{2}$ days produced a high grade concentrate at least equivalent to a unit tank cell which was 27 times larger in volume than the cascade unit.

The embodiments of the invention in which an exclusive property or privilege is claimed are defined as follows:

1. The process of separating minerals or metals from a crushed ore mixture of crushed ore, aqueous solution, and flotation agent which comprises:

flowing the mixture in a confined delivery means;

aspirating air into said mixture flowing in said delivery means; and allowing said mixture to fall freely into a flotation container wherein the mixture is separated whereby aeration of said mixture is achieved by said aspirated air and by aeration produced during said free fall.

2. The process of claim 1, including passing the mixture from said inlet to a header distribution box having a number of header outlets and permitting free fall of the mixture from said number of header outlets into the container.

3. The process of claim 1 or 2, including regulating the surface level of the mixture in the container by dumping excess mixture from the base of the container.

4. An apparatus for separating minerals or metals from a crushed ore mixture wherein a mixture of crushed ore, aqueous solution and flotation agent are frothed, said apparatus consisting of:

a container;

means for delivery of said mixture to said container situated above the container so that an unconfined air space exists between said means for delivery and the surface of the mixture in the container during operation, said mixture falling freely into said container under the influence of gravity, an air intake venturi pipe extending into said delivery means whereby mixture flowing from said delivery means and into said container is aerated by air aspirated through said air intake pipe by said flowing mixture and by aeration during said free fall.

5. The apparatus of claim 4, including a baffle situated in the container, and vertically below the mixture delivery means.

6. The apparatus of claim 5, wherein the baffle is horizontal.

7. The apparatus of claim 5 or 6, including means for varying the vertical height of the baffle relative to the level of the surface of the mixture during operation.

8. The apparatus of claim 5, including means for varying the angle of inclination of the baffle.

9. The apparatus of claim 5, wherein the baffle is on the surface of the mixture during operation.

10. The apparatus of claim 5, wherein the baffle is below the surface of the mixture during operation.

11. The apparatus of claim 4, including a shield upstanding above the mixture level in the container during operation and below the mixture delivery means so that free falling mixture passes through the shield.

12. The apparatus of claim 4, said delivery means including a header distribution box into which the mixture passes and a number of header outlets from the distribution box, each of the header outlets having an air inlet pipe and being situated above the container so that an air space exists between each of the header outlets and the upper surface of the mixture in the container during operation.

13. The apparatus of claim 4, including a controlling valve near the base of the container for dumping mixture to control the surface level of the mixture in the container.

14. The apparatus of claim 4, including a collecting launder at the top of the container for collecting froth.

* * * * *